US007305763B2

(12) United States Patent
Genise et al.

(10) Patent No.: US 7,305,763 B2
(45) Date of Patent: Dec. 11, 2007

(54) HYDROFORMED PORT LINER

(75) Inventors: David Gerard Genise, Marshall, MI (US); Suzanne M. Zampaloni, Marshall, MI (US); Andrew P. Harman, Battle Creek, MI (US); Michael A. Zampaloni, Marshall, MI (US); Farhang Pourboghrat, Okemos, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 264 days.

(21) Appl. No.: 11/189,322

(22) Filed: Jul. 26, 2005

(65) Prior Publication Data

US 2007/0022982 A1 Feb. 1, 2007

(51) Int. Cl.
*F01N 3/00* (2006.01)

(52) U.S. Cl. ..... 29/888.061; 123/193.5

(58) Field of Classification Search ..... 29/888.06, 29/888.061; 123/193.5, 193; 72/60–63; 60/272, 282

See application file for complete search history.

(56) References Cited

U.S. PATENT DOCUMENTS 4,018,195 A 4/1977 Bandrowski, Jr.
4,026,598 A 5/1977 Koike
4,034,723 A 7/1977 Hamparian
4,046,114 A 9/1977 Hamparian et al.
4,103,487 A 8/1978 Yamazaki et al.
4,207,660 A * 6/1980 Rao et al. ..... 29/888.01
4,430,856 A 2/1984 Niedert
4,604,779 A * 8/1986 Narita et al. ..... 29/888.061
4,676,064 A * 6/1987 Narita et al. ..... 60/272
5,150,572 A 9/1992 Johnson et al.
5,170,557 A 12/1992 Rigsby
5,321,964 A 6/1994 Shimanovski et al.
5,349,817 A 9/1994 Bekkering
5,363,544 A 11/1994 Wells et al.
5,414,993 A 5/1995 Kon
5,475,911 A 12/1995 Wells et al.
5,593,745 A 1/1997 Haselkorn et al.
5,673,470 A 10/1997 Dehlinger et al.
5,715,718 A 2/1998 Rigsby et al.
5,729,975 A 3/1998 Bekkering
5,809,778 A 9/1998 Nording
5,836,065 A 11/1998 Dehlinger et al.
5,842,342 A * 12/1998 Strasser et al. ..... 60/282
5,865,054 A 2/1999 Roper
6,006,567 A 12/1999 Brown et al.

(Continued)

*Primary Examiner*—Marguerite McMahon
(74) *Attorney, Agent, or Firm*—Ian C. McLeod

(57) ABSTRACT

A cylinder head (10) for an internal combustion engine has hydroformed port liners (18) positioned within selected ports, either exhaust and/or intake ports (14, 16). The hydroformed port liner (18) includes an air gap (24) for an insulation layer within the selected port (14, 16) between an outer surface (19) of the hydroformed port liner (18) and the wall of the port (14, 16). A cylinder head (12) with a predetermined port configuration has selected ports (14, 16) cast with protrusions (22). The selected ports (14,16) have a larger diameter than a standard size port diameter for that cylinder head to provide a predetermined port configuration by a preset amount based on the thickness of the hydroformed port liner (18) and a desired air gap (22). Protrusions (22) in the wall of the selected ports (14, 16) or on the insert sleeves (17) facilitate formation of the air gap during the hydroforming process.

10 Claims, 4 Drawing Sheets

U.S. PATENT DOCUMENTS 6,026,570 A 2/2000 Bohm et al.
6,038,769 A 3/2000 Bonny et al.
6,098,437 A 8/2000 Kocer et al.
6,209,372 B1 4/2001 Freeman
6,247,552 B1 6/2001 Kovar et al.
6,343,417 B1 2/2002 Bonny et al.
6,349,468 B1 2/2002 Bonny et al.
6,390,051 B2 * 5/2002 Hilpert et al. ..... 123/193.5
6,502,822 B1 1/2003 Brown
6,519,851 B2 2/2003 Bonny et al.
6,539,764 B2 4/2003 Bonny et al.
6,575,007 B2 6/2003 Hein et al.
6,581,377 B2 6/2003 Carlson et al.
6,629,516 B1 10/2003 Minemi et al.
6,637,246 B1 10/2003 Shimanovski et al.
6,651,327 B1 11/2003 Alder et al.
6,662,611 B2 12/2003 Janssen et al.
2002/0195077 A1 * 12/2002 Rieger ..... 123/193.5
2003/0014968 A1 1/2003 Carlson et al.

* cited by examiner

HYDROFORMED PORT LINER

BACKGROUND

1. Field

A method is disclosed for installing port liners in a cylinder head of an internal combustion engine, and more particularly to a method for installing port liners in the exhaust ports of a cast cylinder head using a tube hydroforming process which results in a cylinder head with hydroformed exhaust port liners.

2. Description of the Related Art

Current methods for forming exhaust ports in an internal combustion engine typically involve casting a cylinder head with single walled exhaust ports. When an engine with this cylinder head design is operating, the exhaust gases exiting the combustion chamber flow through the exhaust port in the cylinder head and lose a significant amount of heat energy. This heat energy is wasted instead of being used to power turbomachinery or for rapid heating of the catalytic converter. Additionally, the engine's cooling system is taxed with removing this waste heat. These results are undesirable. Higher temperatures of the exhaust gases provide for more efficient operation of the catalytic converter which results in lower emissions. Reducing heat transfer of the exhaust gases to the cooling system of the engine allows for a lower coolant system load, that is, radiator size.

Consequently, it is known in this art to install exhaust port liners with a simple straight or curved configuration in the exhaust port or passage of a cylinder head of an internal combustion engine for the purpose of reducing heat transfer between the engine cooling fluid and the exhaust gas. The exhaust port liner maintains the elevated temperature of the exhaust gas, and decreases the rate of heat transfer to the cooling system creating an insulation layer between the exhaust gas and coolant passages in the cylinder head. This reduces the coolant system load and increases the exhaust gas temperature, potentially for recovery in a turbocharger, if so equipped, and maintains higher temperatures of the exhaust gas for more efficient operation of the catalytic converter, especially during engine starting.

There are instances where it may be desirable to use port liners for the intake ports in a cylinder head such as for reducing undesirable heating of the combustion air during the intake process. Lower combustion air temperature improves emissions, knock tolerance, and improves air charge density. Positioning port liners in the intake ports of a cylinder head can be difficult due to the irregular shape or non-uniform diameter of the passage. In recent designs of cylinder heads, the intake ports have complex shapes and cross-sections for the purpose of promoting charge motion in the cylinder. Fitting a port liner within these types of intake ports can be problematic.

There still exists a need for a method of installing port liners in cast cylinder heads. The method should not require any extra machining or boring of the cylinder ports. There is also a need for a method to install port liners in ports that have irregular shapes or non-uniform diameters. The port liner should provide an air gap over a major portion of the liner surface as an insulation barrier for maintaining the elevated temperature of the exhaust gas for an exhaust port, or for reducing undesirable charge air heating of the incoming air for combustion for an intake port.

BRIEF SUMMARY

This need as well as others are accomplished with a method that comprises the steps of providing a cylinder head for an internal combustion engine with at least one port therein, providing protrusions in a wall of at least one port of the cylinder head, positioning an insert sleeve in at least one port of the cylinder head, and applying a hydrostatic pressure to the insert sleeve for expanding the insert sleeve within at least one port for forming a hydroformed port liner in at least one port of the cylinder head. The method further provides a hydroformed port liner arrangement that includes a double walled port in a cylinder head with an air gap between the walls of the port that provide an insulation layer for maintaining the temperature of the gases flowing therethrough.

The method produces an improved cylinder head for an internal combustion engine that comprises a hydroformed port liner disposed in either the exhaust or intake ports, or both if desired, of the cylinder head in an arrangement that includes an air gap between the port liner and the wall of the port for forming an insulation layer and providing the benefits described herein.

The various features of novelty which characterize this disclosure are pointed out with particularity in the claims annexed to and forming a part of this disclosure. For a better understanding of the disclosure and its operating advantages, reference is made to the accompanying drawings, and descriptive matter in which an exemplary embodiment is shown and described.

DETAILED DESCRIPTION

Figure 1B:
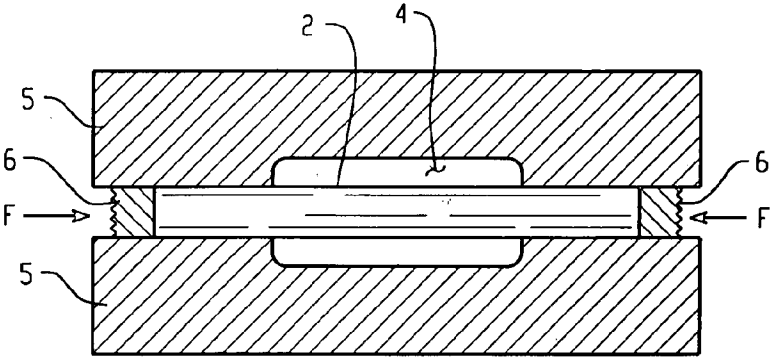
FIG. 1 is a schematic illustration of the tube hydroforming process.
Figure 1D:
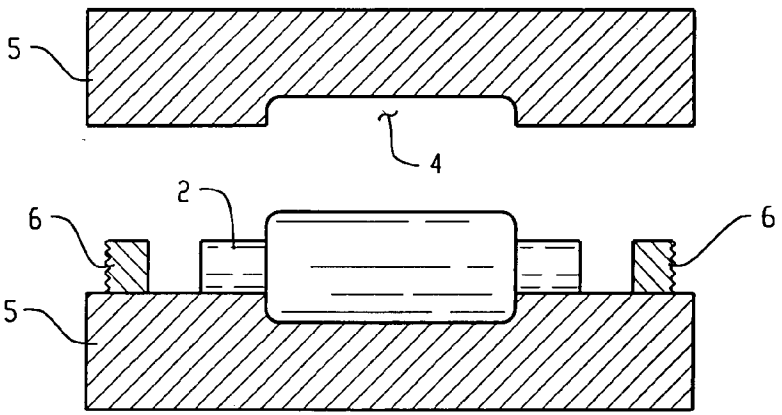
Figure 1A:
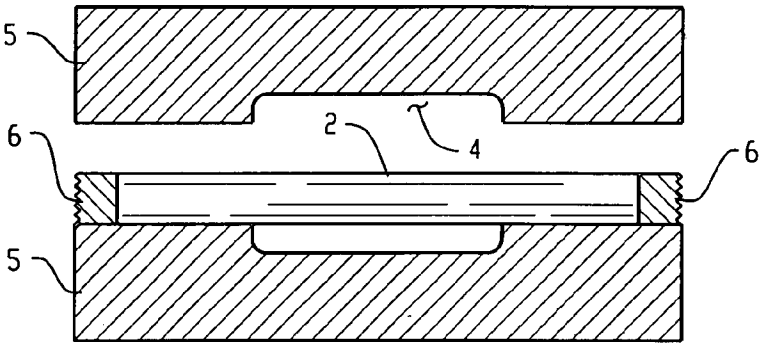
Figure 1C:
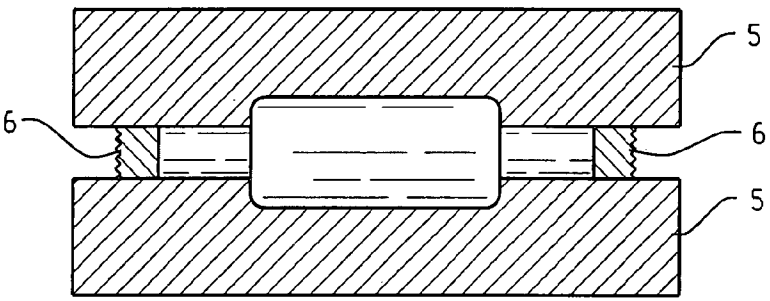

Tube hydroforming is a relatively new process for shaping and forming hollow metal structural parts. While the process is new, it has been utilized in widespread industrial applications in the automotive field, but to the best of the inventors' knowledge this technology has never been applied for forming a double walled port in a cast cylinder head.

The basic premise of the tube hydroforming process is to form a complex hollow part through the combined action of mechanical loading and internal hydrostatic pressure. This technology has been applied to a wide range of metal tube geometries such as those with circular, oval, or even square cross sections as well as to tubes that are straight or even pre-bent prior to hydroforming. Examples of hydroforming assembly dies and seal units and the methods of use include without limitation, U.S. Pat. Nos. 5,321,964; 5,865,054; 6,006,567; 6,502,822; 6,575,007; 6,637,246; 6,651,327; and 6,662,611.

In the drawings, like numerals designate like or similar features throughout the several views, and now referring to FIG. 1, there is depicted a schematic illustration of the tube hydroforming process. A tube 2 is initially placed across a die cavity 4 of a die 5 as seen in FIG. 1(*a*). The die 5 is closed as shown in FIG. 1(*b*), and the ends of tube 2 are sealed with axial feed arms 6 from a hydroforming apparatus (not shown) and pressurized as seen in FIG. 1(*b*) with arrows (F) also illustrating the direction of movement of the axial feed arms 6. The hydrostatic pressure (P) within tube 2 forces the material to deform to the die cavity 4 shape as seen in FIG. 1(*c*). Then, the tube 2 is drained of the pressurizing fluid and the axial feed arms 6 removed, and the die 5 is opened revealing the hydroformed tube 2.

These basic principles of the tube hydroforming process as will be described in far greater detail later herein are utilized for forming a double walled port in a cylinder head of an internal combustion engine.

Figure 2:
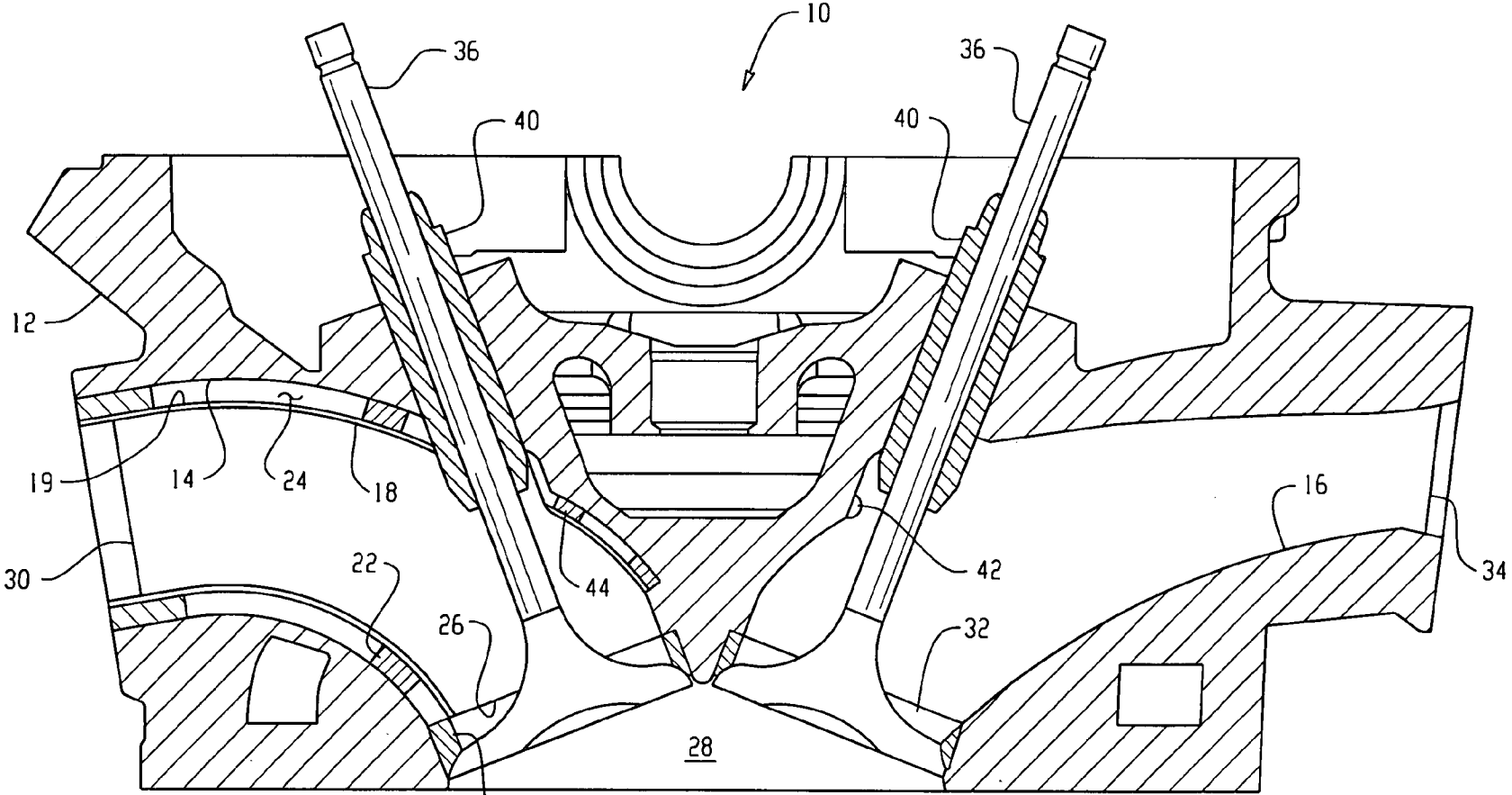
FIG. 2 is a cross-sectional view of a portion of a cylinder head for an internal combustion engine showing exhaust and intake ports and the hydroformed port liner disposed therein.

Next referring to FIG. 2, there is shown a cross-sectional view of a portion of an improved cylinder head generally designated 10. A cast cylinder head 12 includes at least one and typically a plurality of exhaust valve ports or passages 14 and at least one, and typically, a plurality of intake valve ports or passages 16. A hydroformed exhaust port liner 18 is shown disposed within the exhaust valve port 14 to form the double walled port 20. While not shown, the intake valve port 16 may also include a hydroformed port liner similar to hydroformed port liner 18 if desired. The exhaust port 14 has a plurality of protrusions 22, preferably radial or nearly radial projections. Protrusions 22 can be of any producible or castable shape, arranged circumferentially therein to facilitate the hydroforming process and for providing an air gap 24 between the inner surface of the hydroformed port liner 18 and the wall of port 14. Air gap 24 functions as an insulation layer between the cylinder head 12 and the hydroformed port liner 18.

Cylinder head 12 is a conventional cast cylinder head for an internal combustion engine and is typically made of aluminum or cast iron. While cylinder head 12 is shown with only one exhaust port 14 and one intake port 16, it should be understood that a typical cylinder head has a plurality of both exhaust and intake ports. Also, cylinder heads come in many different sizes and shapes. The present method does apply to the various shapes and sizes of the cylinder heads and their respective ports taking into account the size differences involved. The exhaust valve port 14 includes a first end 26 opening into the combustion chamber 28 and second end 30 that exhaust into an exhaust manifold (not shown). The intake valve port 16 also includes a first end 32 that opens into the combustion chamber 28 and a second end 34 that receives intake air from an intake manifold (not shown). A cylinder head assembly will include poppet valves 36, valve seat inserts 38, and valve stem guides 40 which define valve passageways 42 into the ports 14, 16. These components, their structures, and assembly are well known in the industry and require no further description or explanation of operation here. An opening 44 in the hydroformed port liner 18 is in alignment and coextensive with the valve passageway 40 and is sealed therewith.

Since the hydroformed port liner 18 is intended to minimize the heat that is transferred from the exhaust gases to the engine compartment, the first step in the investigation of the present methodology begins with a theoretical heat transfer analysis of the process. This theoretical heat transfer analysis was performed with the aim of determining the following parameters:

Optimum air gap 24 thickness that minimizes heat transfer from the exhaust gases Minimum design guidelines for:

Height of radial projections 22

Thickness of an insert sleeve 17

The analysis was conducted for two distinct cases: $r_3=r_2$ and $r_3>r_2$ where the radii are illustrated schematically in FIG. 3. The following assumptions were used for this analysis.

Constant heat source (sink)

Uniform air gap

Steady-state conditions

One dimension (1D) heat transfer in radial direction

Negligible radiation between air gap and engine block $T_e$ represents the exhaust gas temperature, $T_{oo}$ is the temperature of the engine block, $r_1$ is the inner radius of the insert sleeve 17, $r_2$ is the outer radius of the inner sleeve 17, and $r_3$ is the radius of the exhaust port 14.

Heat transfer analysis constants, for both cases (radius limitations based on experimental tube hydroforming press limits):

Temp. of Exhaust, $T_e$=1500° F.

Temp. of Coolant, $T_{oo}$=190° F.

H.T. Coeff. for air, $K_a$=30.83×10−3 W/m*K

Where "H.T. Coeff." Is "heat transfer coefficient"

W is "Watts"

*K is "degrees Kelvin"

H.T. Coeff. for steel, $K_s$=15.1 W/m*K

Tube Length, L=203.2 mm (8 in)

Radius of Exhaust Port, $r_3$=25.4 mm (1 in)

For both cases, the main variable is the relationship between the radii, $r_1$, $r_2$ and $r_3$.

1st Case (no air gap):

$r_2=r_3$=25.4 mm (1 in)

$r_2-r_1$=0.5-2 mm (0.02-0.08 in)

2nd Case (variable air gap thickness):

$r_3$=25.4 mm (1 in)

$r_2$=24.4-18.4 mm (0.96-0.72 in)

$r_2-r_1$=0.5-2 mm (0.02-0.08 in)

Figure 3:
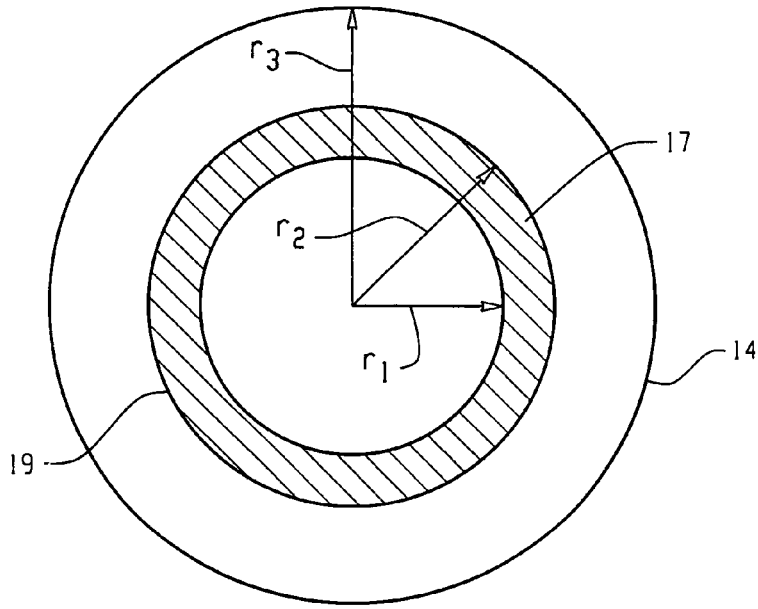
FIG. 3 is a cross-sectional illustration of an exhaust port with an insert sleeve disposed therein.

Based on FIG. 3, a simple one dimensional thermal conduction analysis can be performed as illustrated in Equations 1 and 2.

$$q' = \frac{T_e - T_\infty}{R'_{TOT}} \tag{1}$$

$$R'_{TOT} = \frac{1}{2\pi}\left(\frac{\ln(r_2/r_1)}{k_s} + \frac{\ln(r_3/r_2)}{k_a}\right) \tag{2}$$

Therefore the optimum thickness can be determined by either minimizing q' or maximizing $R'_{TOT}$, resulting in Equation 3.

$$\frac{dR'_{TOT}}{dr} = 0 \tag{3}$$

When $r_2$=r, Equation 2 and 3 can be simplified to Equation 4.

$$r = 1 - \frac{k_a}{k_s} \tag{4}$$

Determining whether this expression is a maximum or a minimum will depend on the second derivative of $R'_{TOT}$ evaluated at $r=1-k_a/k_s$ as shown in Equation 5.

$$\frac{d^2 R'_{TOT}}{dr^2}\left(1-\frac{k_a}{k_s}\right)=\frac{k_s(k_a(2+k_s)-k_s)}{2\pi k_a(k_a-k_s)^2} \quad (5)$$

As long as both $k_a$ and $k_s>0$, this expression will always be >0. Therefore, $r=r_{cr}$, becomes a critical radius implying no optimum radius exists but a minimum does exist, as illustrated in Equation 6.

$$r_{cr}=1-\frac{k_a}{k_s} \quad (6)$$

Figure 4:
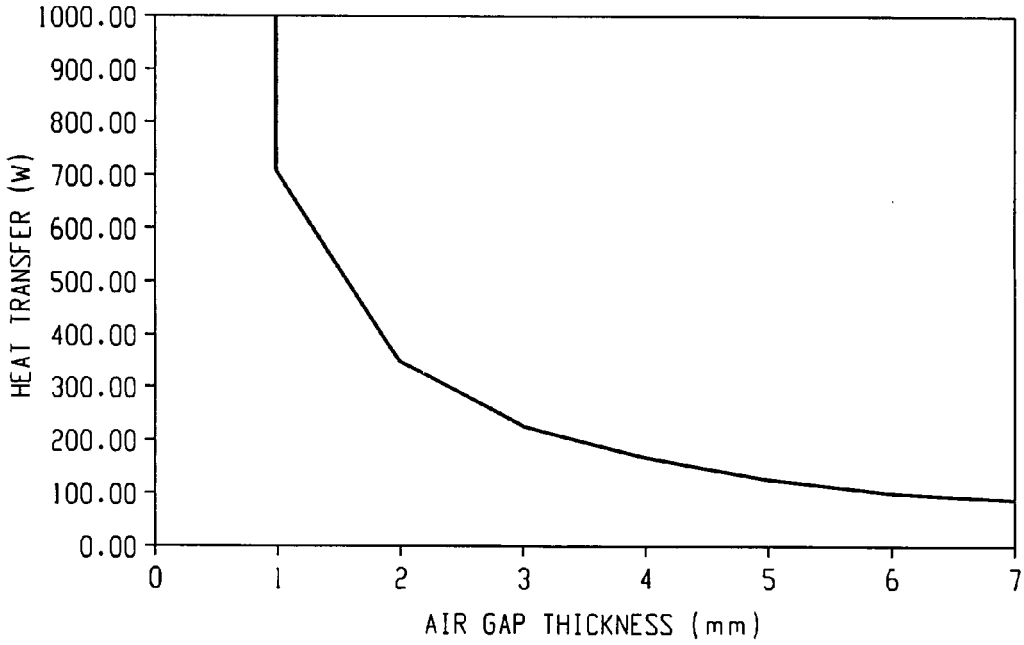
FIG. 4 is a graph of heat transfer versus air gap thickness.

Based on Equation 6, for the given values of $k_a$ and $k_s$, $r_{cr}$=0.998 mm, implying that a minimum 1 mm air gap achieves appreciable changes to heat transfer from this system (i.e. for proper insulation of the exhaust gases). FIG. 4 illustrates the changes in heat transfer for a wide spectrum of air gap thickness values ranging from 1 mm to 7 mm. From FIG. 4 it appears that there is significant insulating advantages up to an air gap thickness of 3 mm and after that point the trend starts to level off. Additionally, FIG. 4 illustrates that in order to have any insulation of the exhaust gases an air gap is necessary. Numerical modeling results indicate that changes to the material thickness of the port liner does not significantly affect the heat transfer in Watts (W) over the same range of air gaps. The thickness of the insert sleeve 17 material is fairly insignificant when compared to the advantages gained in changes to the air gap size.

After initial numerical modeling and simple experimentation the focus was placed on developing a process that maintains an air gap with the protrusions 22 being radial projections placed at set locations around the circumference of a tube or insert sleeve. Three different radial projection sizes for the protrusions 22 were evaluated; 6 mm wide radial projections, 3 mm wide radial projections and 1.5 mm wide radial projections. All three were designed to maintain a minimum of 1 mm air gap around the entire insert sleeve 17 when expanded to form the hydroformed port liner 18.

Experiments were conducted on 203.2 mm (8 in) long, 50.8 mm (2 in) diameter tubes or insert sleeves with a wall thickness of 1 mm (0.039 in) in order to minimize modifications. Experiments were run using a variety of boundary conditions such as feeding the ends of the tubes axially during forming, allowing the ends of the tube to float freely during the processing and using a combination of axial feed and free-float. The only restriction on the ends of the tubes was to ensure that pressure within the tube was maintained throughout processing. The tubes tested were both a high carbon and a low carbon stainless steel.

The present method involves hydroforming the port liner until the liner is in contact with the upper surface or top of the protrusions. Insufficient hydroforming pressure will not cause the port liner to touch the upper surface of the protrusion, and an unpredictable final shape of the port liner will result. Excessive hydroforming pressure will cause the port liner to over expand in between the protrusions, again yielding uncontrolled shape of the finished liner and stress concentrations at the edges of the protrusions. For the low carbon stainless steel a pressure of 2000 psi and for the high carbon stainless steel a pressure of 4000 psi caused the material to bulge past the surface of a test liner die therefore giving it characteristics that are similar to excess material feed. In other words, the bulge was too large. At 1800 and 3000 psi, respectively, the material would deform up to the upper surface of the radial projections providing minimal amounts of point loading at the locations of the radial projections. This surface point loading could be removed or reduced by the application of a more accurately controlled pressure-loading curve. The hydrostatic pressure required to achieve the foregoing result will depend upon the insert sleeve material and thickness, it is envisionable that the hydrostatic pressure could range as high as and possibly greater than 10,000 psi for some applications.

The use of 6 mm wide radial projections provided very good results. A uniform air gap is maintained during the processing and the radial projection size is designed such that a minimal point load is placed on the port liner or tube.

The results for the 3 mm radial projections were very similar to the results for the 6 mm radial projections. The only difference is that the surface area of contact between the radial projections and the tube is much smaller. Whether this is an advantage or a disadvantage may be a factor of a number of variables including radial projection shape, cyclical loading properties and radial projection location.

The results from the 1.5 mm radial projections were very similar to the other two cases except for one distinction. For these parts there was a higher tendency to create such a point load at the radial projection/tube interface that some of the test specimens would rupture at this location. This demonstrates that there is an effective limit to the size of the radial projections that can be used to adequately create the air gap for the port liner.

Even though two different types of protrusions 22 were considered for the purposes of creating the air gap, it is envisionable that protrusions 22 may include other forms. The first type of protrusion was the radial projection previously discussed and a second type of protrusion consisted of a series of 3 mm thick annular rings placed within the die. The purpose of the rings would be to provide an inner surface for the tube to form against while preventing any type of point loading on the insert sleeve. Many other forms of the protrusions 22 are possible and the present method is not intended to be limited to a particular form of protrusion.

The effect of using annular rings versus radial projections for the protrusion 22 has a minimal effect on the finished shape of the formed tube, but there are other factors that may be considered. Both the radial projections and the annular ring have the potential to act as heat sinks while the exhaust gases are flowing through the hydroformed port liner. Due to the larger area of the rings the heat that is transferred will be much higher than the amount lost due to radial projections. The second factor to be considered is control of the amount of waviness that may be introduced into the hydroformed port liner. If the hydroformed port liner is formed past the locations of the radial projections or annular rings there is the potential to introduce an uneven surface along the length of the hydroformed port liner. When using annular rings, this creates waves in the hydroformed port liner that extend around the diameter of the hydroformed port liner. In contrast, an uneven surface caused by the radial projections will only be located at small intervals, rather than extending around the diameter of the hydroformed port liner. This could have an effect on the flow of the gases through the sleeve and would need to be taken into consideration as a part of such a design. The third factor for consideration is the manufacture of the cylinder head 12 itself. Casting annular rings versus radial projections may become an issue depending on the size of the structures and the specific locations.

An experimental exhaust port was designed for illustrative purposes to have a 45.5 mm opening that provides a finished insert opening of 39 mm. Radial projections were located at approximately 45° intervals around the circumference of the tube and various members of radial projections and radial projection sizes were investigated. For the sake of simplicity, the insert sleeve 17 was modeled to have a uniform thickness of 1.5 mm regardless of original shape (i.e. pre-bent tube, straight tube, etc.).

For the numerical modeling, all the insert sleeves 17 were based on the same material at the same internal pressures. Radial projections were evenly distributed around the manifold and were designed to provide a 3 mm air gap uniformly around the insert sleeve 17. The goal was not to optimize the processing but rather to determine the parameters necessary for maintaining an air gap around the sleeve 17. The variety of cases evaluated included the following boundary conditions:

Fixed Ends
Free Ends
One Free/One Fixed End
Bent Tube Extensions
Straight Tube Extensions
No axial feed applied to the free ends of the tubes The first example is where a pre-bent tube was placed in the die and both ends of the tube were fixed. The tube experiences an excessive amount of thinning, especially along the upper part of the tube. This is not unexpected since the material is expected to deform to the shape of the die but no additional material is allowed to flow into the deformation area. This led to the second example where both ends were allowed to float with the deformation, that is the ends were free to move. In this example no additional material was introduced so the final shape was far from optimum. In the example where one end was fixed and the other was left free to deform with the part, the part started to show better behavior, less thinning in the upper regions, but illustrates the need for additional material to be drawn into the chamber during processing.

The next approach was to extend the pre-bent tube outside of the forming chamber and to allow the extended end to draw into the chamber during processing. The other end of the tube was fixed to allow for some material stretch during the tube hydroforming process. One of the problems encountered during this process was that there was some excessive wrinkling occurring in the lower portion of the finished part that was attributed to the pre-bent nature of the tube. This led to the approach to use a straight-line extension instead of a pre-bent extension outside of the forming chamber. This led to the result that showed the best overall behavior of the material. The tube hydroforming system employed for these tests was an Interlaken Model HF-125 with a 125,000 pound capacity hydroforming press.

Figure 5:
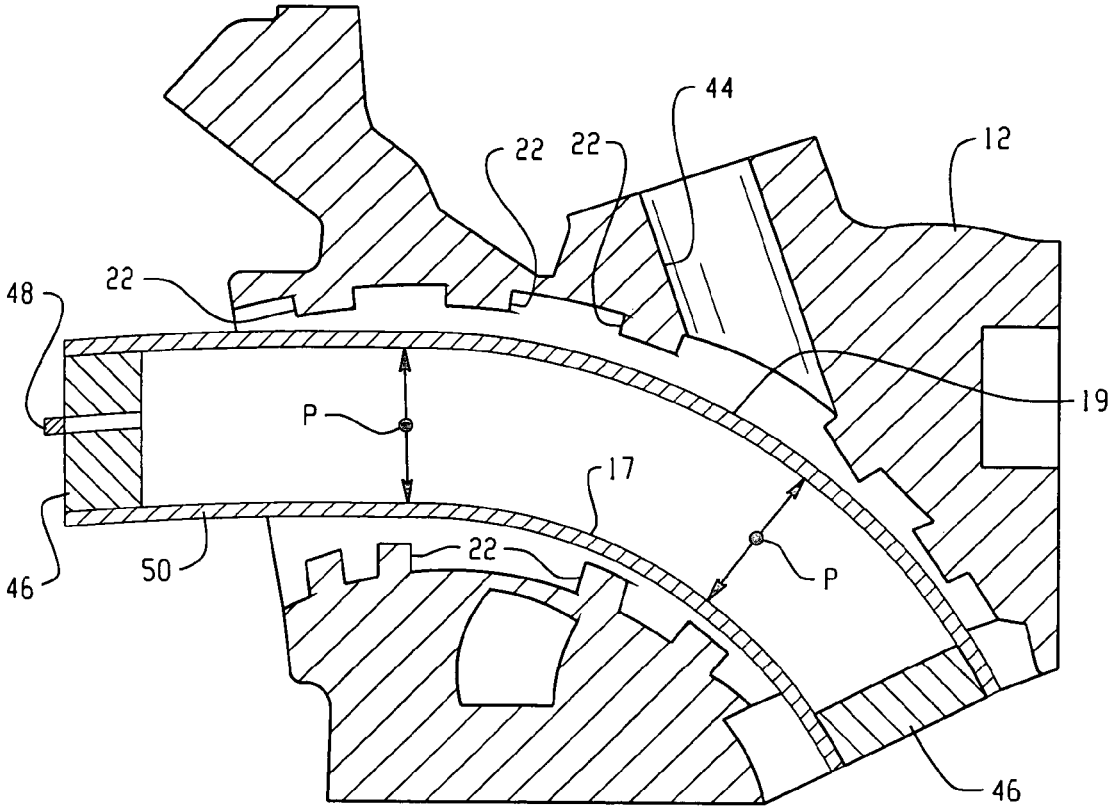
FIG. 5 is a cross-sectional view of an enlarged portion of an exhaust port of a cylinder head with an insert sleeve disposed therein.

Now referring to FIG. 5, there is depicted an insert sleeve 17 positioned inside the exhaust port 14 of the cylinder head 12 prior to hydroforming. The straight-line extension 50 at one end of insert sleeve 17 as described previously allows for some material stretch during the hydroforming process and additional material introduction.

Protrusions 22 depicted as radial projections cast in the cylinder head 12 are constructed to facilitate formation of the air gap 24 as the insert sleeve 17 is hydrostatically expanded. The radial projections 22 facilitate the formation of the air gap 24 as previously described herein between the outer surface of the insert sleeve 17 as it undergoes hydraulic expansion to form the hydroformed port liner 18 and the wall of the exhaust port 14. The radial projections 22 may also function to seal the air gap 24 in selected places of the hydroformed port liner 18 in the port 14, for example, the opening 44 for the valve passageway 42, or at one of the ends 26, 30 of the exhaust port 14. The valve seat inserts 38 can also function to seal the air gap 24 of the hydroformed port liner 18 at the first end 26 of the exhaust port. A flange on the exhaust manifold (not shown, but a structure well known to those in this art) can also be used to seal the air gap 24 of the hydroformed port liner 18 at the second end 30 of the exhaust port 14. Alternatively, wire mesh material, graphite material, grafoil, metal material, a ceramic material, a high temperature polymeric material, or combinations thereof used as gaskets or seals may be used for sealing the air gap 24 as necessary.

The radial projections 22 are made integral with the port during the casting process, or alternatively affixed inside the port by welding, such as friction welding, the radial projections therein. Still another alternative embodiment includes using an insert sleeve 17' with the radial projections already positioned on its outer surface 19 so that upon hydroforming the radial projections are forced up against the wall of the port 14. Any suitable method of deploying the protrusions 22 within the port may be used with the instant method.

Referring now more specifically to the method of the present disclosure and again to FIG. 5, there is depicted a metal insert sleeve 17 preferably made of stainless steel having a wall thickness ranging from about 0.8 millimeters (mm) to about 3.0 mm, and more preferably to about 1.0 mm. Insert sleeve 17 is pre-bent to loosely slide within the port 14 as shown. While in this embodiment insert sleeve 17 is depicted as being curved, it should be understood that the insert sleeve 17 will have essentially the general shape of the port 14 that it is intended for use in the cylinder head 12. The shape can be a linear shape, a curved shape, or a complex shape as seen in the intake port 16 shown in FIG. 1. Even though the insert sleeve 17 is shown disposed within the exhaust port 14 of the cylinder head 12 only, it should further be understood that the method of this disclosure is intended to be equally applicable to the intake port 16 as well. The insert sleeve 17 has a diameter sized to easily fit within the exhaust port 14 and preferably includes a straight-line extension 50.

Axial feed arms 46 of a hydroforming apparatus (not shown), like the Interlaken Model HF-125 or any equivalent or newer model, are placed in both ends of the insert sleeve 17 as illustrated in FIG. 5. The axial feed arms 46 and hydroforming apparatus are devices known in the art and require no explanation here. A hydrostatic pressure is applied through an inlet valve 48 or the like in one or both of the axial feed arms 46. The pressure of the fluid in the insert sleeve 17 is increased to an amount such as 3000 psi to expand the insert sleeve 17 outwardly to contact the upper surface of the radial projections 22 with minimal amounts of point loading at the surface locations of the radial projections 22. The term "point loading" as used herein is intended to mean the indentations that the tops or upper surfaces of the radial projections 22 make in the insert sleeve 17 during the hydroforming process. This radial outward expansion is shown by arrows P in FIG. 6. During the hydroforming process, the cylinder head 12 is supported to resist movement during processing. After the insert sleeve 17 is hydraulically expanded to form the hydroformed port liner 18, the straight-line extension 50 may remain in place, or be trimmed, cut-off, machined, or flared, if required or desired, so that the hydroformed port liner 18 fits securely within port 14 as depicted in FIG. 1. The straight-line extension 50 length may be calculated to provide any required additional material to compensate for any thinning of the liner during the hydraulic expansion so that it is not necessary to trim or cut-off any excess.

Advantageously, the foregoing method forms a double walled port 20 in a conventional cast cylinder head. The method allows the hydroformed port liner 18 to be installed in either the exhaust or intake ports, or both ports of the cylinder head of an internal combustion engine in a cost effective manner. The port liner may be installed in ports that have irregular or complex shapes, and non-uniform diameters.

While specific embodiments have been shown and described in detail to illustrate the application of the principles described herein, it will be understood that other embodiments may be made otherwise without departing from such principles.

We claim:

1. A method for making an improved cylinder head having a predetermined port configuration with selected double walled ports for an internal combustion engine, comprising the steps of:

providing a cast cylinder head for an internal combustion engine with selected ports for port liners, said selected ports having a larger diameter than a standard port size for the cylinder head by a preset amount as determined for a double walled port configuration;

providing protrusions in the walls of the selected ports for facilitating formation of an air gap;

positioning insert sleeves in the selected ports of the cylinder head; and applying hydrostatic pressure to the insert sleeves within the selected ports of the cylinder head to hydraulically expand the insert sleeves up to upper surfaces of the protrusions in the walls of the selected ports for making hydroformed port liners within the selected ports and for forming said air gap between an outer surface of each hydroformed port liner and the wall of the selected port.

2. A method according to claim 1, wherein the step of casting the cylinder head further comprises the step of casting protrusions in the walls of the selected ports.

3. A method according to claim 1, wherein the step of applying hydrostatic pressure to the insert sleeves further comprises the steps of providing axial feed arms to each end of the insert sleeves, and pressurizing a hydraulic fluid within the insert sleeves to a magnitude sufficient to expand the insert sleeve outwardly to an extent where the outer surface of the liner contacts the upper surfaces of the protrusions.

4. A method according to claim 1, wherein the step of providing the protrusions in the walls of the selected ports further comprises the step of welding protrusions in the walls of the selected ports.

5. A method according to claim 1, wherein each of the insert sleeves further comprises a straight-line extension that extends outside of the selected port, said straight-line extension being drawn into the selected port with application of the hydrostatic pressure.

6. A method according to claim 1, wherein the air gap comprises a gap of at least approximately one millimeter.

7. A method according to claim 1, wherein the step of providing protrusions comprises the step of providing the protrusions on an outer surface of the insert sleeves.

8. A method according to claim 6, wherein the insert sleeve comprises a wall thickness of at least approximately one millimeter.

9. A method for forming a double walled port in a cylinder head, comprising the steps of:

providing a cylinder head with at least one port therein;

providing protrusions in a wall of the at least one port of the cylinder head;

positioning an insert sleeve in the at least one port of the cylinder head; and applying a hydrostatic pressure to the insert sleeve for expanding the insert sleeve within the at least one port for forming a hydroformed port liner in the at least one port of the cylinder head.

10. A method as recited in claim 9, further comprising the step of forming an air gap between an outer surface of the hydroformed port liner and the at least one wall of the port of the cylinder head.

* * * * *